US010786892B2

(12) United States Patent
Endo et al.

(10) Patent No.: US 10,786,892 B2
(45) Date of Patent: Sep. 29, 2020

(54) STAPLING DEVICE

(71) Applicant: UCHIDA YOKO GLOBAL LIMITED, Tokyo (JP)

(72) Inventors: Toshimasa Endo, Kanagawa (JP); Toshihiko Osanai, Tokyo (JP)

(73) Assignee: UCHIDA YOKO GLOBAL LIMITED, Tokyo (JP)

( * ) Notice: Subject to any disclaimer, the term of this patent is extended or adjusted under 35 U.S.C. 154(b) by 184 days.

(21) Appl. No.: 15/758,164

(22) PCT Filed: Nov. 30, 2015

(86) PCT No.: PCT/JP2015/005955

§ 371 (c)(1),
(2) Date: Mar. 7, 2018

(87) PCT Pub. No.: WO2017/094040

PCT Pub. Date: Jun. 8, 2017

(65) Prior Publication Data

US 2018/0243892 A1 Aug. 30, 2018

(51) Int. Cl.
*B25C 5/02* (2006.01)
*B25C 5/15* (2006.01)

(52) U.S. Cl.
CPC ..... *B25C 5/0207* (2013.01); *B25C 5/02* (2013.01); *B25C 5/0228* (2013.01); *B25C 5/15* (2013.01)

(58) Field of Classification Search
CPC ..... B27F 7/19; B27F 7/21; B27F 7/36; B25C 5/0207; B25C 5/02; B25C 5/0228; B25C 5/15; B65H 37/04; B65H 2408/12–125; B42C 1/12; B31F 5/00; G03G 2215/00822; G03G 2215/00864; G03G 2215/00827;
(Continued)

(56) References Cited

U.S. PATENT DOCUMENTS 5,346,114 A * 9/1994 Udagawa ..... B25C 5/1627 227/120
5,791,548 A * 8/1998 Udagawa ..... B25C 5/1606 227/120
(Continued)

FOREIGN PATENT DOCUMENTS

EP 1582322 A1 10/2005
JP 2004-90167 A 3/2004
(Continued)

OTHER PUBLICATIONS

International Search Report for corresponding App. No. PCT/JP2015/005955, dated Feb. 9, 2016.

*Primary Examiner* — Chelsea E Stinson
(74) *Attorney, Agent, or Firm* — Renner, Otto, Boisselle & Sklar, LLP

(57) ABSTRACT

To allow a single stapling device to easily function as both an eyeglass-clinch stapling device and a flat-clinch stapling device, the stapling device includes a staple delivering portion (a knock pin) delivering a staple, a supporting table (a platform) for paper, and a clincher bending legs of the staple. The staple delivering portion, the supporting table, and the clincher are relatively movable. The stapling device further includes a controller (an operation timing controller) variably controlling timings when the staple delivering portion and the clincher move relative to the supporting table.

4 Claims, 9 Drawing Sheets

(58) Field of Classification Search
CPC ..... B65B 35/00; G05D 13/162; G05B 2219/23393; G05B 2219/15006; G05B 2219/32076; G05B 2219/34407; G05B 2219/25367; G05B 13/021; G05B 7/02
USPC ..... 227/155, 131; 270/37, 58.07, 58.08; 700/213, 9, 14, 28, 75, 304, 306
See application file for complete search history.

(56) References Cited

U.S. PATENT DOCUMENTS 5,799,935 A * 9/1998 Yamanushi ..... B42B 4/00 270/58.08
5,806,750 A * 9/1998 Yamanushi ..... B27F 7/36 227/131
6,484,921 B2 * 11/2002 Hakozaki ..... B27F 7/19 227/155
6,634,536 B2 * 10/2003 Yoshie ..... B27F 7/19 227/131
9,352,604 B2 * 5/2016 Kubota ..... B65H 37/04
2001/0023887 A1 * 9/2001 Hakozaki ..... B27F 7/19 227/155
2001/0050302 A1 * 12/2001 Hakozaki ..... B27F 7/21 227/155
2005/0269381 A1 * 12/2005 Kobayashi ..... B27F 7/19 227/155
2006/0000864 A1 * 1/2006 Yoshie ..... B27F 7/006 227/131
2006/0086770 A1 * 4/2006 Kobayashi ..... B27F 7/006 227/111
2006/0091180 A1 * 5/2006 Kurabayashi ..... B27F 7/19 227/131
2006/0273134 A1 * 12/2006 Smith ..... B25C 5/0207 227/131
2007/0289758 A1 * 12/2007 Olson ..... B27F 7/19 173/1
2009/0294510 A1 12/2009 Kameda
2010/0096430 A1 * 4/2010 Sugihara ..... B27F 7/19 227/155
2010/0301090 A1 * 12/2010 Matsui ..... B27F 7/21 227/7
2011/0095469 A1 * 4/2011 Williams ..... B42B 4/00 270/58.04
2011/0098848 A1 * 4/2011 Marcinik ..... B65H 31/34 700/230
2011/0147431 A1 * 6/2011 Sugihara ..... B27F 7/006 227/143
2014/0042203 A1 * 2/2014 Abe ..... B25C 5/1603 227/120
2016/0313687 A1 * 10/2016 Osada ..... G03G 15/6541

FOREIGN PATENT DOCUMENTS

JP 2009-285770 A 12/2009
WO 95/19248 A1 7/1995

* cited by examiner

STAPLING DEVICE

TECHNICAL FIELD

The present invention relates to a stapling device that staples a plurality of sheets of paper together with a staple.

BACKGROUND ART

Stapling devices which staple a plurality of sheets of paper together with a staple and which are referred to as, for example, staplers, are designed to deliver a U-shaped staple, pierce legs of the staple through the sheets of paper, and fasten the sheets of paper together with ends of the staple bent with a clincher. Examples of such stapling devices include a so-called "eyeglass-clinch" stapling device, which bends legs of a staple in the bending process described above such that the orientations of the ends of the staple are changed by 90° or more. In this type of stapling device, the ends of the staple are folded back to face the sheets of paper. This can make it less likely for the ends to touch something else such as human's finger. On the other hand, a so-called "flat-clinch" stapling device has been also known (see, for example, Patent Document 1). In the flat-clinch stapling device, setting the timing when a clincher operates to be different from that of the eyeglass-clinch stapling device allows portions of the staple near the root of legs thereof to be bent by about 90° with distal end portions of the legs of the staple kept substantially straight. This can reduce the total thickness of the stapled sheets of paper.

CITATION LIST

Patent Documents

[Patent Document 1] Japanese Unexamined Patent Publication No. 2009-285770

SUMMARY

Technical Problem

However, clinchers of the eyeglass-clinch stapling device and the flat-clinch stapling device operate in different ways. This makes it impossible for a single stapling device to function as both eyeglass-clinch and flat-clinch stapling devices.

It is therefore an object of the present invention to allow a single stapling device to easily function as both eyeglass-clinch and flat-clinch stapling devices.

Solution to the Problem

A stapling device according to a first aspect of the invention includes:

a staple delivering portion delivering a staple;

a supporting table for paper; and a clincher bending legs of the staple. The staple delivering portion, the supporting table, and the clincher are relatively movable. The stapling device further includes a controller variably controlling timings when the staple delivering portion and the clincher move relative to the supporting table.

A second aspect of the invention is an embodiment of the first aspect of the invention. The controller is switchable between first timing control to bring the clincher into contact with the supporting table or the paper at a timing earlier than a timing when the staple pierces the paper, and second timing control to bring the clincher into contact with the supporting table or the paper at a timing later than the timing when the staple pierces the paper.

A third aspect of the invention is an embodiment of the second aspect of the invention. The first timing control is performed to bring the clincher into contact with the supporting table or the paper at a timing that allows the staple to be clinched in an eyeglass-clinching manner.

A fourth aspect of the invention is an embodiment of the second aspect of the invention. The second timing control is performed to bring the clincher into contact with the supporting table or the paper at a timing that allows the staple to be clinched in an flat-clinching manner.

According to these aspects, operating the staple delivering portion and the clincher at different timings allows the single stapling device to perform a stapling operation in two modes, namely, flat-clinch and eyeglass-clinch modes.

A fifth aspect of the invention is an embodiment of any one of the first through fourth aspects of the invention. The stapling device further includes a motor driving at least one of the staple delivering portion, the supporting table, or the clincher. The controller is configured to control an operating timing of the motor.

According to this aspect, simply changing the operating timing while operations are performed in the same sequence allows easy switching between the stapling modes as described above.

Advantages of the Invention

According to the present invention, a single stapling device can easily function as both an eyeglass-clinch stapling device and a flat-clinch stapling device.

DESCRIPTION OF EMBODIMENTS

Embodiments of the present invention will now be described in detail with reference to the drawings.

(Configuration for Stapling Device)

As shown in FIGS. 1 to 5, a stapling device includes a body and a clincher unit 130. The body is disposed above a platform 141 (a supporting table) on which sheets of paper are placed, and includes a base block unit 110 and a knock pin unit 120. The clincher unit 130 is disposed below the platform 141.

Figure 1:
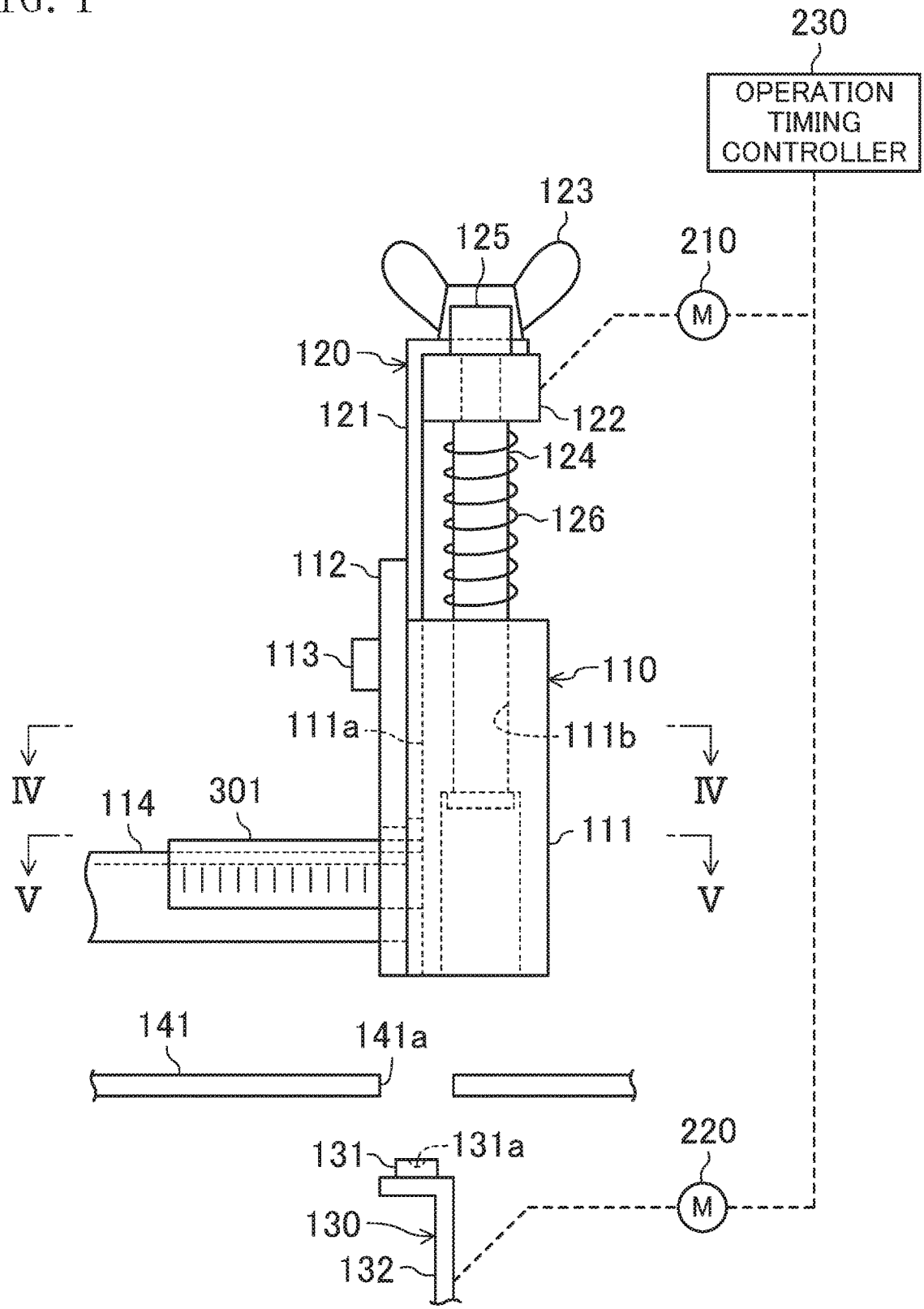
FIG. 1 is a side view of a major portion of a stapling device.
Figure 2:
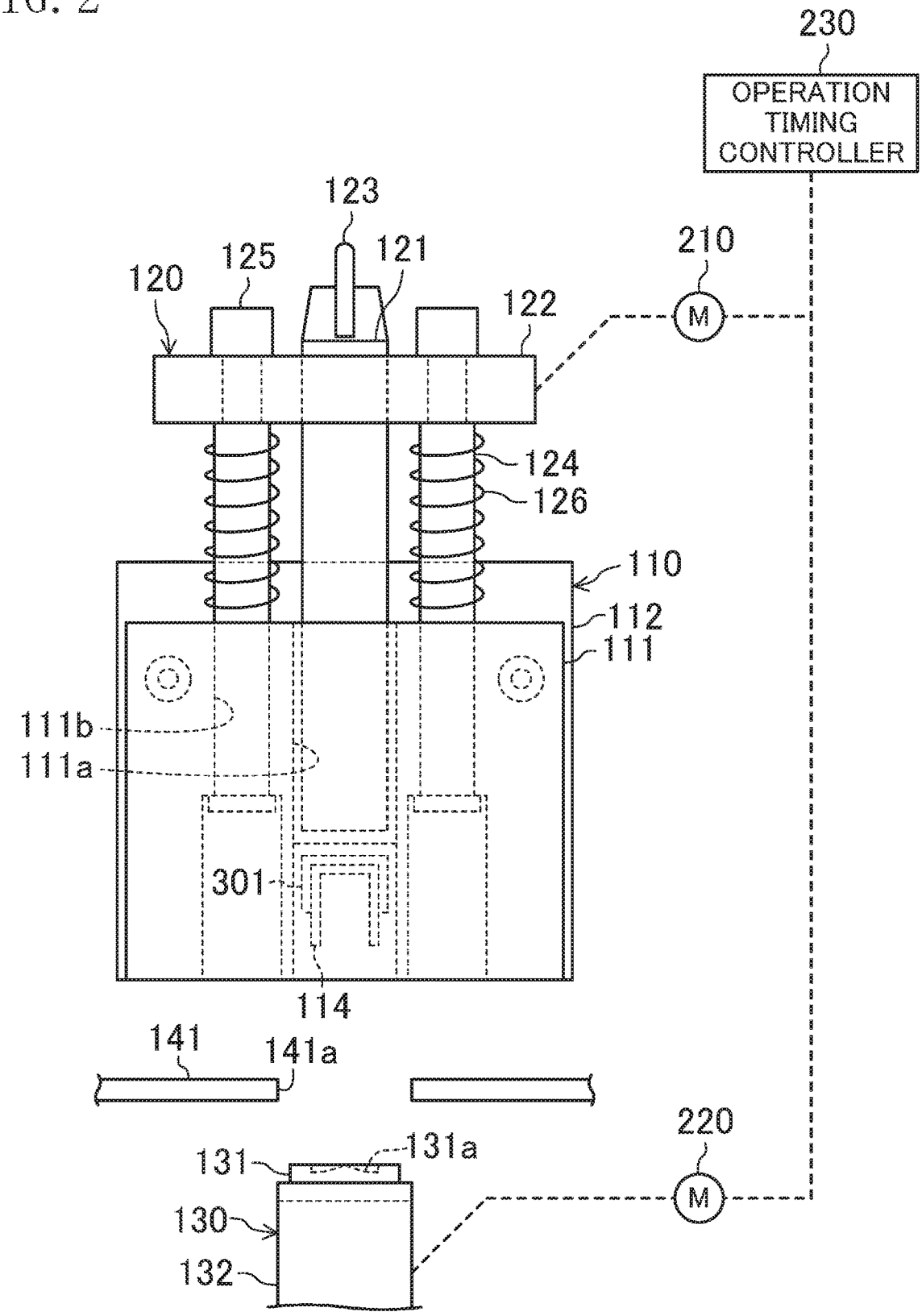
FIG. 2 is a front view of a major portion of a stapling device.
Figure 3:
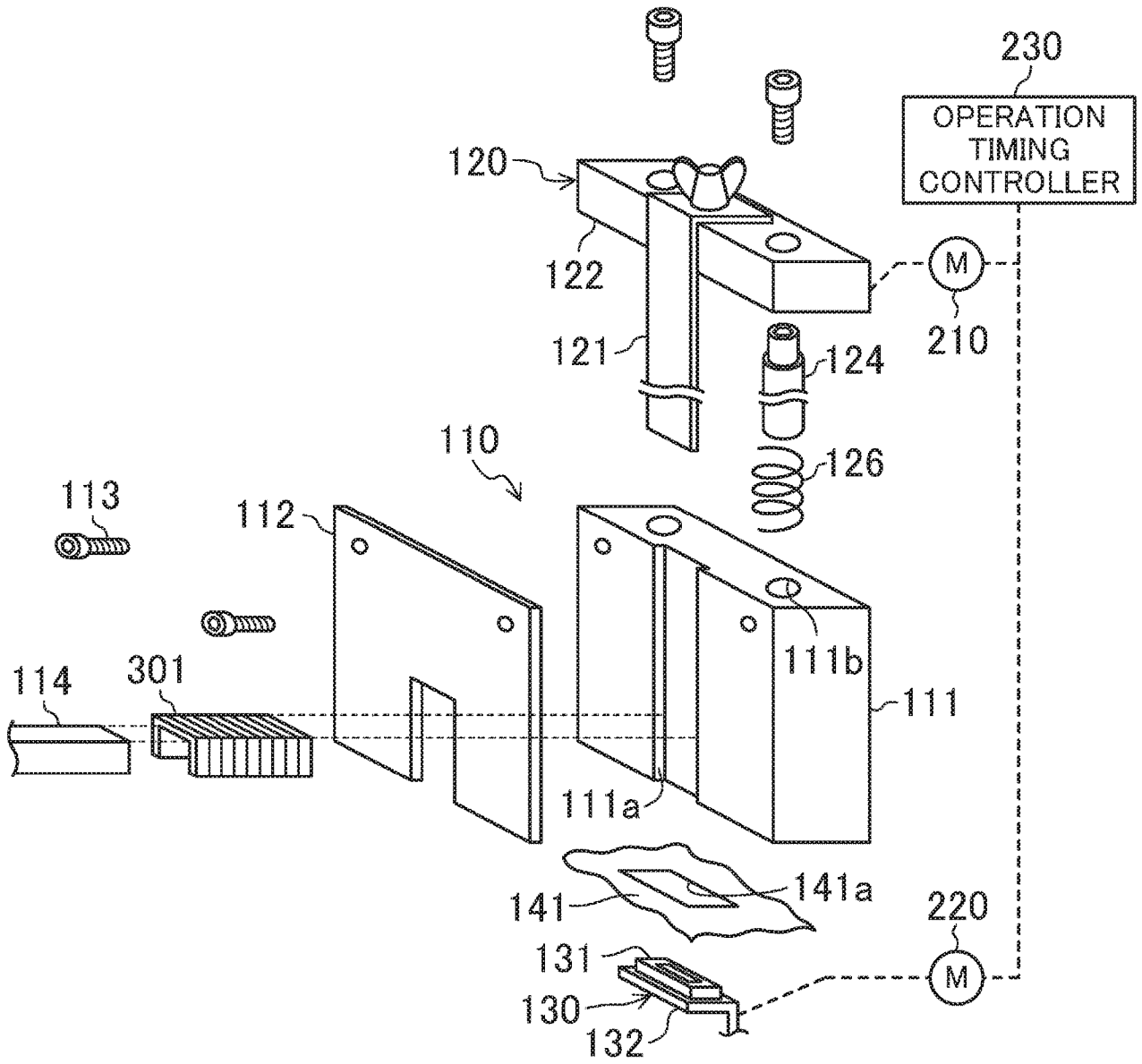
FIG. 3 is an exploded perspective view of a major portion of a stapling device.
Figure 4:
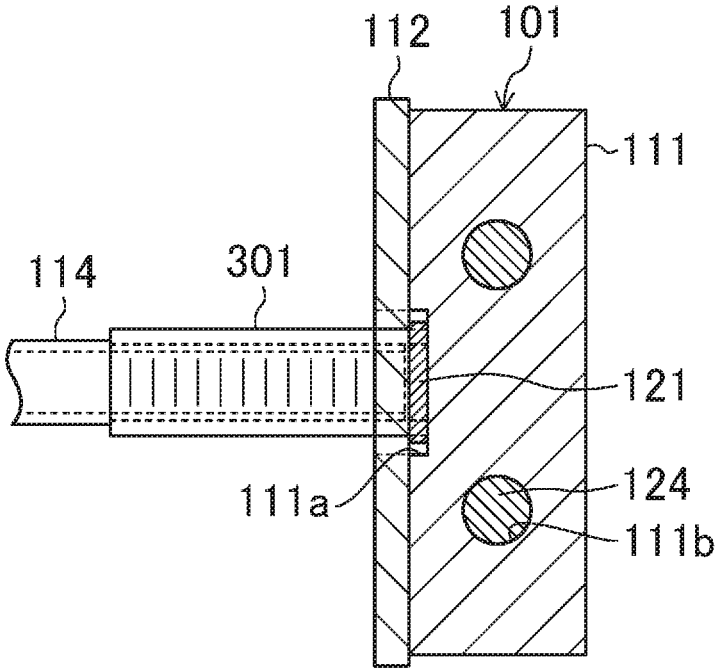
FIG. 4 is a cross-sectional view taken along line IV-IV shown in FIG. 1.
Figure 5:
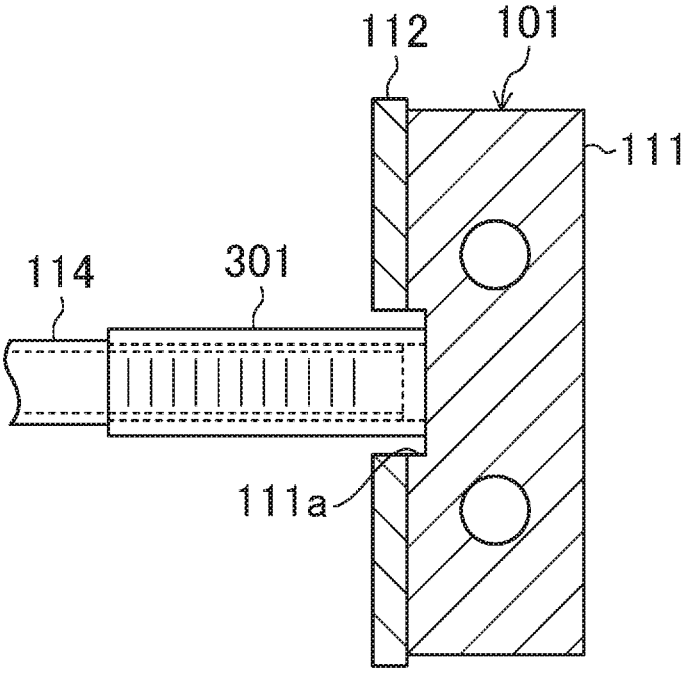
FIG. 5 is a cross-sectional view taken along line V-V shown in FIG. 1.
Figure 6:
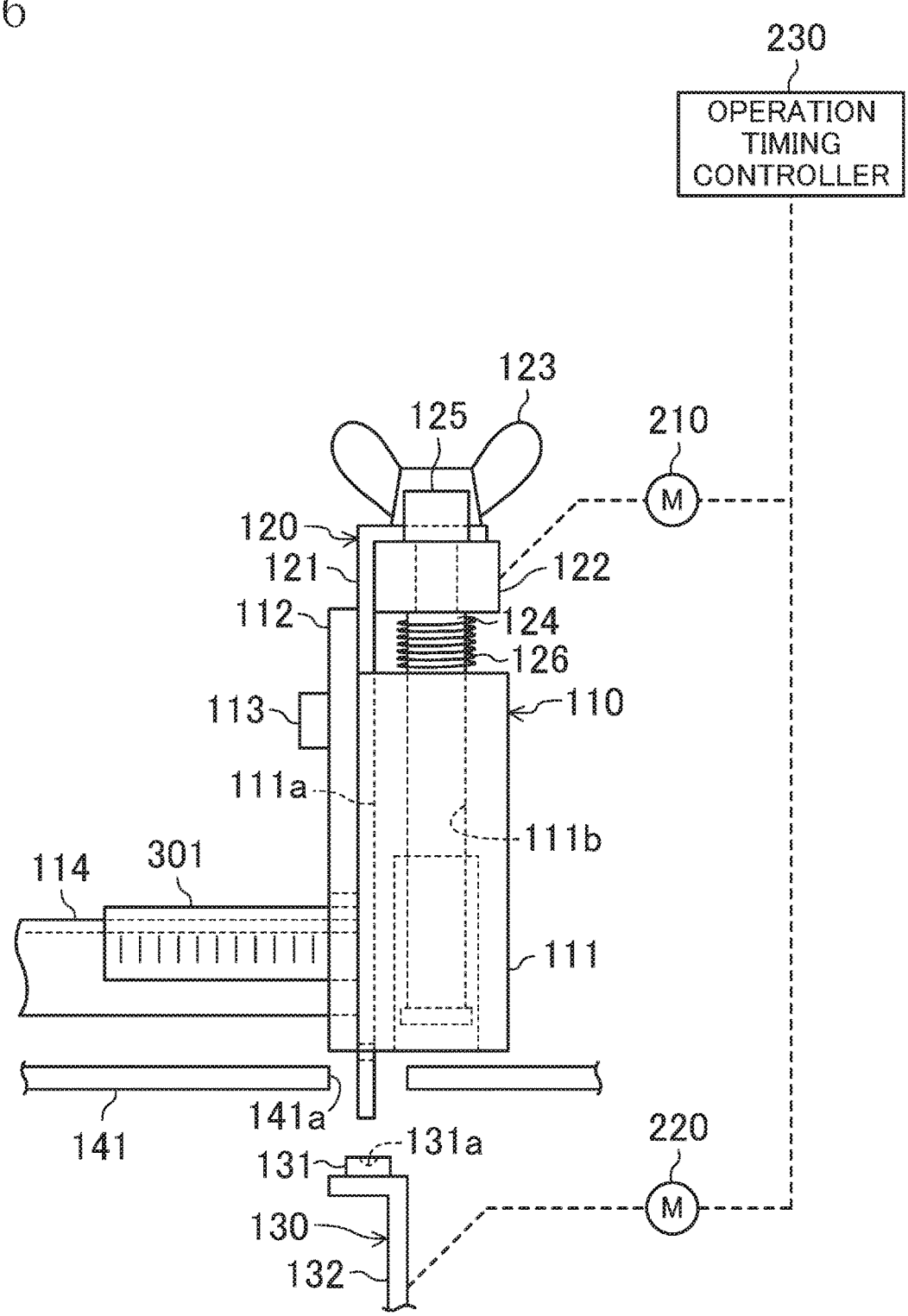
FIG. 6 is a side view illustrating the process of operating a stapling device.
Figure 7:
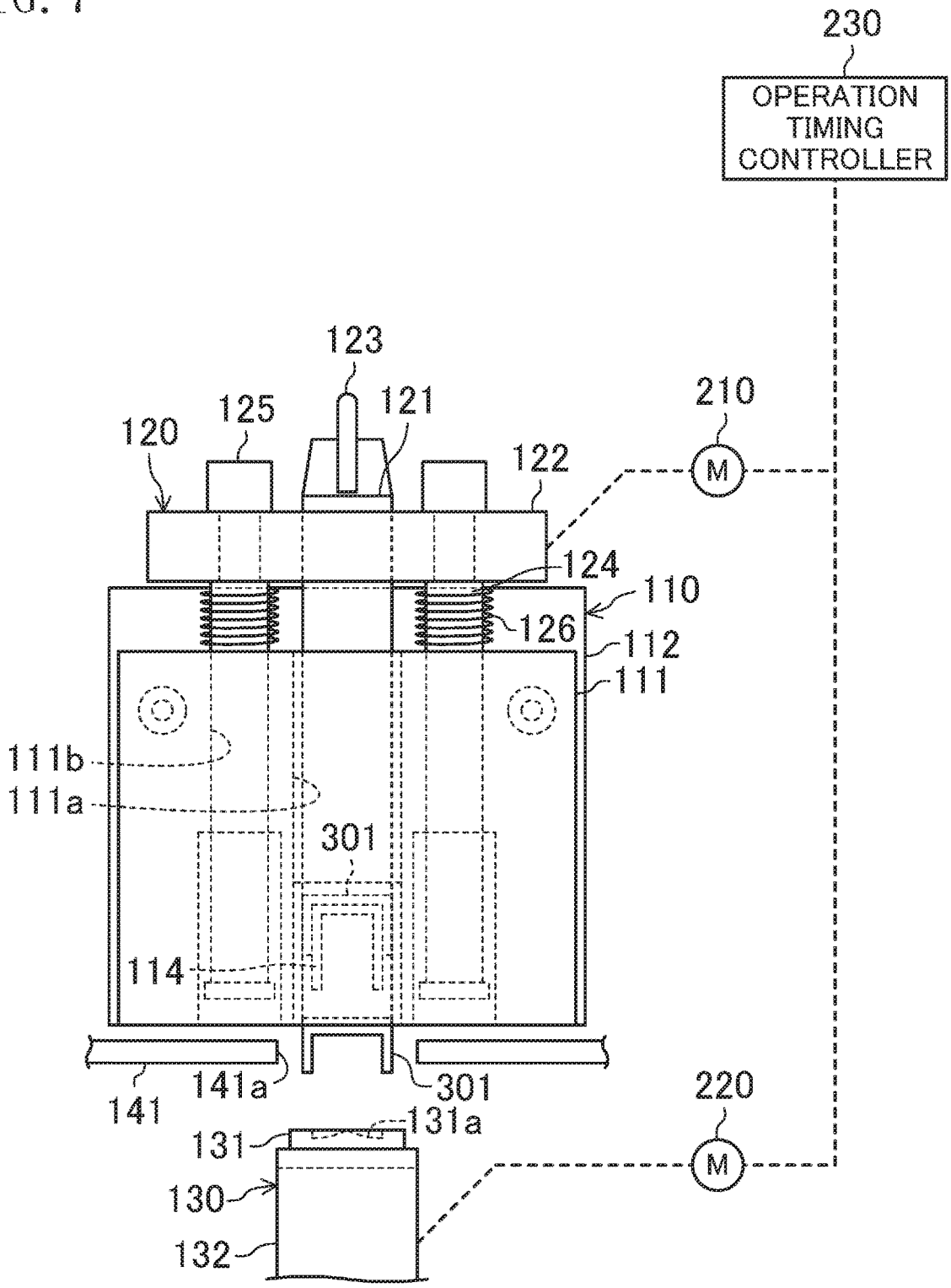
FIG. 7 is a front view illustrating the process of operating a stapling device.

The base block unit 110 is designed to retain staples 301. As shown in FIGS. 6 and 7, the base block unit 110 itself is vertically movable, and is designed to guide the knock pin unit 120 so that the knock pin unit 120 is vertically movable. The base block unit 110 includes a base block 111, a presser plate 112, and a staple guide 114. The base block 111 has a knock pin guide groove 111*a* which vertically guides a knock pin 121 (a staple delivering portion) of the knock pin unit 120. The presser plate 112 is attached to the base block to cover the knock pin guide groove 111*a*, and is fixed with bolts 113. The staple guide 114 is also attached to the base block unit 110 with, for example, a bracket (not shown for simplicity). The staple guide 114 retains the staples 301, and guides them toward a destination.

The knock pin unit 120 includes a knock pin 121, and a support block 122 to which the knock pin 121 is attached with a wing screw 123. The knock pin 121 delivers each of the staples 301 to the paper. A pair of slide shafts 124 are attached to the support block 122 with respective bolts 125, and are slidably guided through respective shaft guide holes 111*b* of the base block 111. This allows the support block 122 to move vertically. In addition, the support block 122 is biased upward by springs 126.

The clincher unit 130 includes a vertically movable support plate 132, and a clincher 131 attached to the support plate 132. A clinch groove 131*a* of the clincher 131 is used to bend end portions of one of the staples 301 protruding through an opening 141*a* of the platform 141, thus making it possible to staple the sheets of paper.

The knock pin unit 120 and the clincher unit 130 are driven by a knock pin drive motor 210 and a clincher drive motor 220, respectively, to move upward and downward. The base block unit 110 moves upward and downward together with the knock pin unit 120 while being in non-contact with the paper. The motors 210 and 220 are controlled at respective independent timings by an operation timing controller 230 as described later.

Figure 8:
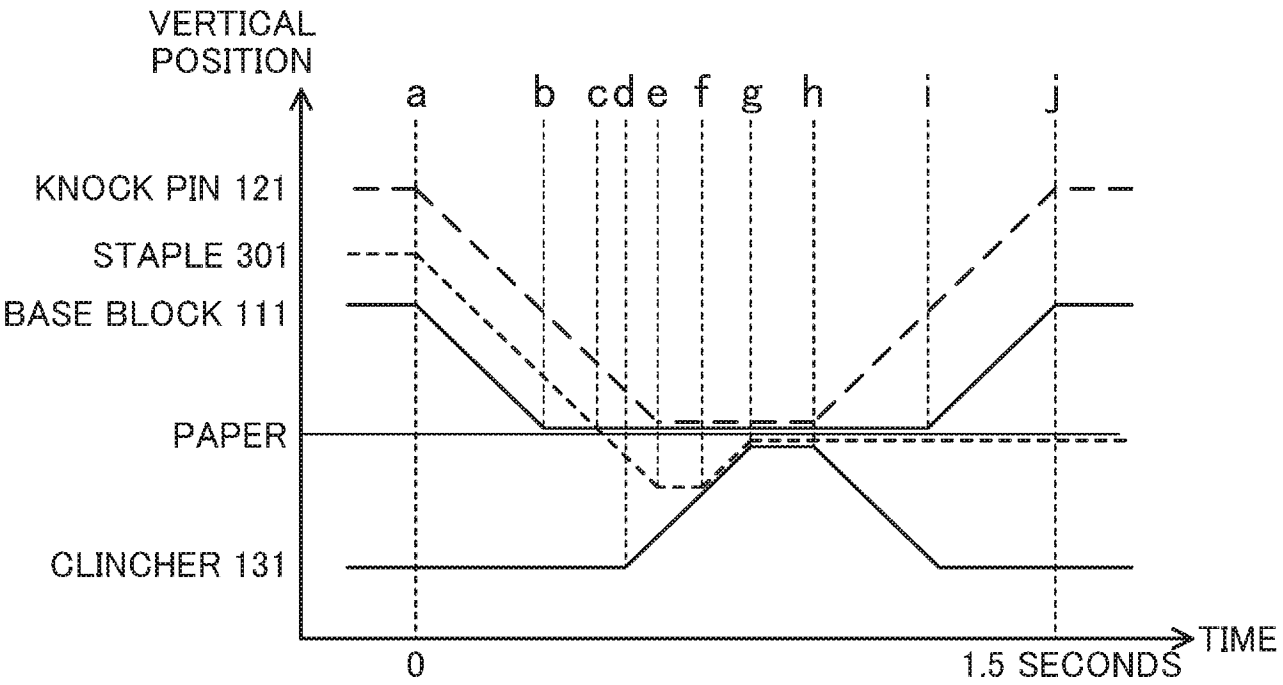
FIG. 8 is a timing chart showing the timings when components of a stapling device operate in a flat-clinch mode.

(Operation of Stapling Device: Flat Clinching) If the stapling device configured as described above operates in a flat-clinch mode, the operation timing controller 230 controls the motors 210 and 220 so that operations shown in FIG. 8 and indicated below are performed.

(a) First, the base block 111 and the knock pin 121 move downward at the same timing. Likewise, the staples 301 move downward in synchronization with the downward movement of the base block 111.

(b) The base block 111 stops when its lower end moves down to paper. Meanwhile, the knock pin 121 keeps moving downward. Thus, a leading one of the staples 301 is separated from the other staples to move downward together with the knock pin 121.

(c) After a while, end portions of the leading staple 301 reach the paper. Even after that, the leading staple 301 keeps moving downward in synchronization with the downward movement of the knock pin 121, and reaches a position where the leading staple 301 pierces the paper.

(d) The clincher 131 starts moving upward at a predetermined timing. The timing is set to be, for example, a timing when, after the end portions of the staple 301 reach their lowermost position, the clincher 131 has some leeway to come into contact with the staple 301.

(e) The knock pin 121 and the staple 301 stops moving downward when reaching their lowermost positions.

(f) When moving upward to reach the end portions of the staple 301, the clincher 131 starts bending the staple 301, which is clinched in a flat-clinching manner.

(g) When the clincher 131 reaches its uppermost position to come into contact with the paper, the flat-clinching is completed, and the clincher 131 stops moving upward.

(h) The knock pin 121 starts moving upward, and the clincher 131 starts moving downward, in good time after the completion of the flat-clinching. The clincher 131 stops moving downward when reaching its lowermost position.

(i) In addition to the upward movement of the knock pin 121, the base block 111 also starts moving upward to separate from the paper.

(j) When the knock pin 121 and the base block 111 return to their uppermost positions, they stop moving upward. The flat-clinching operation is thus completed.

(Operation of Stapling Device: Eyeglass Clinching)

Figure 9:
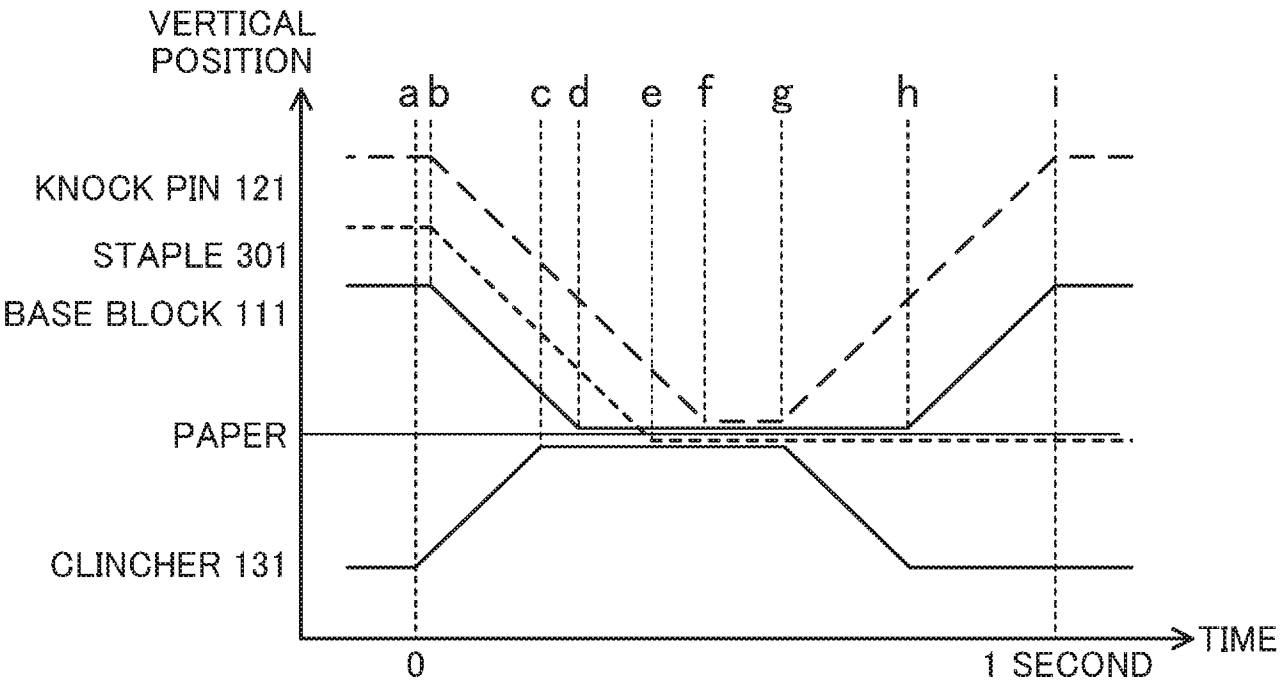
FIG. 9 is a timing chart showing the timings when components of a stapling device operate in an eyeglass-clinch mode.

If the stapling device operates in an eyeglass-clinch mode, the operation timing controller 230 controls the motors 210 and 220 so that operations shown in FIG. 9 and indicated below are performed. This eyeglass-clinch mode is significantly different from the flat-clinch mode in that the clincher 131 moves upward in advance.

(a) The clincher 131 starts moving upward at a timing that allows the clincher 131 to rise to a height to come into contact with the paper sufficiently earlier than the timing when one of the staples 301 pierces the paper.

(b) The base block 111, the knock pin 121, and the staples 301 start moving downward as in the flat-clinch mode.

(c) The clincher 131 stops moving upward in good time as described above when reaching its uppermost position to come into contact with the paper.

(d) As in step (b) performed in the flat-clinch mode, the base block 111 stops when its lower end moves down to the paper, whereas the knock pin 121 keeps moving downward. A leading one of the staples 301 is separated from the other staples to move downward together with the knock pin 121.

(e) After a while, end portions of the leading staple 301 reach the paper. After that, the clincher 131, which has already moved upward as described above, starts bending the staple 301 in synchronization with the downward movement of the knock pin 121, and the staple 301 is clinched in an eyeglass-clinching manner.

(f) The knock pin 121 stops moving downward when reaching its lowermost position. At this time, the eyeglass-clinching is completed.

(g) Operations similar to those performed in steps (h) to (j) in the flat-clinch mode are performed in the following steps. Specifically, the knock pin 121 starts moving upward, and the clincher 131 starts moving downward, in good time after the completion of the eyeglass-clinching. The clincher 131 stops moving downward when reaching its lowermost position.

(h) In addition to the upward movement of the knock pin 121, the base block 111 also starts moving upward to separate from the paper.

(i) When the knock pin 121 and the base block 111 return to their uppermost positions, they stop moving upward, and the eyeglass-clinching is completed.

The configuration described above allows operations of the knock pin unit 120 and the clincher unit 130 to be independently controlled, and allows the knock pin unit 120 and the clincher unit 130 to operate at different timings. Thus, the single stapling device can perform a stapling operation in the two modes, namely, flat-clinch and eyeglass-clinch modes. In particular, the operation timing controller 230 controlling the motors 210 and 220 allows the knock pin unit 120 and the clincher unit 130 to be controlled at respective independent timings. This can facilitate the switching between the clinch modes.

Other Embodiments

Just like the flat-clinch mode, the clincher 131 does not always have to be vertically moved in the eyeglass-clinch mode as described above. For example, when the operating mode is switched to the eyeglass-clinch mode, the clincher 131 may be moved to a position to come into contact with paper, and fixed to that position while sheets of paper are stapled in the eyeglass-clinching manner. However, if the clincher 131 is vertically moved with every stapling operation as described above, qualitatively the same operations merely need to be performed at different timings in any stapling operation. This makes it easier to perform control.

The mechanical structure of the stapling device described above is merely an example. The stapling device may have any one of various structures having the same function.

The timings when the units operate are merely typical examples. The relative timings when the units operate, leeway in timing, the relative speeds at which the units operate, and other parameters merely need to be differently set depending on the quality and number of sheets of paper to be stapled, specifications of staples, and other factors.

Making the drive motors for the units controllable at respective independent timings as described above can facilitate switching between the clinch modes. However, this is merely an example. For example, even if the timings when the units operate are controlled by a mechanism such as a cam, mechanically changing this control makes it possible for the single stapling device to perform a stapling operation in the two modes.

DESCRIPTION OF REFERENCE CHARACTERS

110 Base Block Unit
111 Base Block
111*a* Knock Pin Guide Groove
111*b* Shaft Guide Hole
112 Presser Plate
113 Bolt
114 Staple Guide
120 Knock Pin Unit
121 Knock Pin
122 Support Block
123 Wing Screw
124 Slide Shaft
125 Bolt
126 Spring
130 Clincher Unit
131 Clincher
131*a* Clinch Groove
132 Support Plate
141 Platform
141*a* Opening
210 Knock Pin Drive Motor
220 Clincher Drive Motor
230 Operation Timing Controller
301 Staple

The invention claimed is:

1. A stapling device comprising:
a staple delivering portion configured to deliver a staple having legs;
a supporting table configured to support paper;
a clincher configured to bend the legs of the delivered staple, wherein the staple delivering portion is movable relative to the supporting table and the clincher is movable relative to the supporting table;
a controller configured to select between two timing modes to control a timing of the movement of the staple delivering portion and the clincher relative to the supporting table, wherein:
the controller includes a first timing mode and a second timing mode;
in the first timing mode, the controller causes the clincher to contact the supporting table or the paper before the staple pierces the paper, and
in the second timing mode, the controller causes the clincher to contact the supporting table or the paper after the staple has pierced the paper.

2. The stapling device of claim 1, wherein
in the first timing mode, the clincher contacting the supporting table or the paper before the staple pierces the paper causes the staple to be clinched in an eyeglass-clinching manner.

3. The stapling device of claim 1, wherein
in the second timing mode, the clincher contacting the supporting table or the paper after the staple pierces the paper causes the staple to be clinched in a flat-clinching manner.

4. The stapling device of claim 1, further comprising:
a motor driving at least one of the staple delivering portion, the supporting table, or the clincher, wherein
the controller is configured to control the driving by the motor of the at least one of the staple delivering portion, the supporting table, or the clincher.

* * * * *